US009849671B2

(12) United States Patent
Shepherd

(10) Patent No.: US 9,849,671 B2
(45) Date of Patent: Dec. 26, 2017

(54) ADJUSTING THE FIRING TIMES OF A NUMBER OF NOZZLES

(71) Applicant: HEWLETT-PACKARD DEVELOPMENT COMPANY, L.P., Houston, TX (US)

(72) Inventor: Matthew A. Shepherd, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/101,366

(22) PCT Filed: Jan. 30, 2014

(86) PCT No.: PCT/US2014/013776
§ 371 (c)(1),
(2) Date: Jun. 2, 2016

(87) PCT Pub. No.: WO2015/116089
PCT Pub. Date: Aug. 6, 2015

(65) Prior Publication Data

US 2016/0303851 A1 Oct. 20, 2016

(51) Int. Cl.
*B41J 2/045* (2006.01)
*B41J 29/38* (2006.01)

(52) U.S. Cl.
CPC ..... *B41J 2/04573* (2013.01); *B41J 2/0458* (2013.01); *B41J 2/04545* (2013.01); *B41J 2/04586* (2013.01); *B41J 29/38* (2013.01)

(58) Field of Classification Search
CPC .. B41J 2/04573; B41J 2/04545; B41J 2/0458; B41J 2/04586; B41J 29/38
See application file for complete search history.

(56) References Cited

U.S. PATENT DOCUMENTS

| | | | | |
|---|---|---|---|---|
| 5,534,895 | A | 7/1996 | Lindenfelser et al. | |
| 5,923,344 | A † | 7/1999 | Norum et al. | |
| 5,997,124 | A | 12/1999 | Capps et al. | |
| 6,154,230 | A | 11/2000 | Holstun et al. | |
| 6,217,147 | B1 † | 4/2001 | Holstun | |
| 6,270,185 | B1 † | 8/2001 | Askeland | |
| 6,318,832 | B1 | 11/2001 | Bates | B41J 2/5056 347/15 |
| 6,422,678 | B1 † | 7/2002 | Serra et al. | |
| 6,669,330 | B2 † | 12/2003 | Vanhooydonck et al. | |

(Continued)

OTHER PUBLICATIONS

Epson, "Next-Generation Inkjet Technology," (Research Paper), Sep. 2013, 15 Pages, available at http://www.epson.com/_alfresco/LandingPages/landing/PrecisionCore/PrecisionCore_White_Paper.pdf.†

*Primary Examiner* — Thinh H Nguyen
(74) *Attorney, Agent, or Firm* — Fabian VanCott

(57) ABSTRACT

A printer comprising a printhead comprising a number of non-staggered nozzles and a processor communicatively coupled to the printhead, in which the processor executes computer usable program code to adjust the firing time of a number of nozzles within a group of nozzles by a portion of a full dot row. A method comprising, with a processor, adjusting the firing time of a number of nozzles within a group of nozzles of a printhead by a portion of a full dot row by delaying the firing of a subset of those nozzles by a full dot row, in which the nozzles of the printhead are not staggered.

15 Claims, 10 Drawing Sheets

(56) References Cited

U.S. PATENT DOCUMENTS

| | | | |
|---|---|---|---|
| 7,073,883 | B2 † | 7/2006 | Billow |
| 8,100,498 | B2 | 1/2012 | Picciotto et al. |
| 2003/0184614 | A1 † | 10/2003 | Torgerson et al. |
| 2006/0098044 | A1 † | 5/2006 | Pulver et al. |
| 2006/0268056 | A1 † | 11/2006 | Molinet et al. |
| 2007/0008354 | A1 | 1/2007 | Hayashi et al. |
| 2009/0002439 | A1 | 1/2009 | Hayashi et al. |
| 2009/0033702 | A1 † | 2/2009 | Clark |
| 2009/0079780 | A1 † | 3/2009 | Picciotto et al. |

† cited by third party

| V Scan Axis DISTANCE Domain (equiv 11*1200=13,200dpi) | P1 0 | 1 | 2 | 3 | 4 | 5 | 6 | 7 | 8 | 9 | 10 | P3 0 | 1 | 2 | 3 | 4 | 5 | 6 | 7 | 8 | 9 | 10 | - |
|---|---|---|---|---|---|---|---|---|---|---|---|---|---|---|---|---|---|---|---|---|---|---|---|
| | | | | | | | | | | | | | | | | | | | | | | | |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | | | | | | | | | | | | | | | | | | | | | | | |
| 2 | | | | | | | | | | | | | | | | | | | | | | | |
| 3 | | | | | | | | | | | | | | | | | | | | | | | |
| 4 | | | | | | | | | | | | | | | | | | | | | | | |
| 5 | | | | | | | | | | | | | | | | | | | | | | | |
| 6 | | | | | | | | | | | | | | | | | | | | | | | |
| 7 | | | | | | | | | | | | | | | | | | | | | | | |
| 8 | | | | | | | | | | | | | | | | | | | | | | | |
| 9 | | | | | | | | | | | | | | | | | | | | | | | |
| 10 | | | | | | | | | | | | | | | | | | | | | | | |
| 0 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 1 | | | | | | | | | | | | | | | | | | | | | | | |
| 2 | | | | | | | | | | | | | | | | | | | | | | | |
| 3 | | | | | | | | | | | | | | | | | | | | | | | |
| 4 | | | | | | | | | | | | | | | | | | | | | | | |
| 5 | | | | | | | | | | | | | | | | | | | | | | | |
| 6 | | | | | | | | | | | | | | | | | | | | | | | |
| 7 | | | | | | | | | | | | | | | | | | | | | | | |
| 8 | | | | | | | | | | | | | | | | | | | | | | | |
| 9 | | | | | | | | | | | | | | | | | | | | | | | |
| 10 | | | | | | | | | | | | | | | | | | | | | | | |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

200

*Fig. 2*

| V Scan Axis DISTANCE Domain (equiv 11*1200=13,200dpi) | P1 0 | 1 | 2 | 3 | 4 | 5 | 6 | 7 | 8 | 9 | 10 | P3 0 | 1 | 2 | 3 | 4 | 5 | 6 | 7 | 8 | 9 | 10 | - |
|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | | | | | | | | | | | | | | | | | | | | | | | |
| 2 | | | | | | | | | | | | | | | | | | | | | | | |
| 3 | | | | | | | | | | | | | | | | | | | | | | | |
| 4 | | | | | | | | | | | | | | | | | | | | | | | |
| 5 | | | | | | | | | | | | | | | | | | | | | | | |
| 6 | | | | | | | | | | | | | | | | | | | | | | | |
| 7 | | | | | | | | | | | | | | | | | | | | | | | |
| 8 | | | | | | | | | | | | | | | | | | | | | | | |
| 9 | | | | | | | | | | | | | | | | | | | | | | | |
| 10 | | | | | | | | | | | | | | | | | | | | | | | |
| 0 | 1 | 1 | 1 | 1 | 1 | 1 | 1 | 1 | 1 | 1 | 1 | 0 | 0 | 0 | 0 | 0 | 0 | 0 | 0 | 0 | 0 | 0 | 0 |
| 1 | | | | | | | | | | | | | | | | | | | | | | | |
| 2 | | | | | | | | | | | | | | | | | | | | | | | |
| 3 | | | | | | | | | | | | | | | | | | | | | | | |
| 4 | | | | | | | | | | | | | | | | | | | | | | | |
| 5 | | | | | | | | | | | | | | | | | | | | | | | |
| 6 | | | | | | | | | | | | | | | | | | | | | | | |
| 7 | | | | | | | | | | | | | | | | | | | | | | | |
| 8 | | | | | | | | | | | | | | | | | | | | | | | |
| 9 | | | | | | | | | | | | | | | | | | | | | | | |
| 10 | | | | | | | | | | | | | | | | | | | | | | | |
| 0 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 |

300

*Fig. 3*

ADJUSTING THE FIRING TIMES OF A NUMBER OF NOZZLES

BACKGROUND

Printers are frequently used to receive digital image data from an image source and men print that data on a print medium to form a printed image. During printing, however, the actual location of drops deposited on the printing medium may become misplaced resulting in a location error know as scan axis directionality ("SAD"). Other printing errors may also result thereby creating a relatively less desirable print quality.

BRIEF DESCRIPTION OF THE DRAWINGS

The accompanying drawings illustrate various examples of the principles described herein and are a part of the specification. The examples do not limit the scope of the claims.

FIG. 2 is a distance domain spreadsheet indicating the firing times for a number of nozzles in a printhead according to another example.

FIG. 3 is a distance domain spreadsheet indicating the firing times for a number of nozzles in a printhead according to yet another example.

Throughout the drawings, identical reference numbers designate similar, but not necessarily identical, elements.

DETAILED DESCRIPTION

Figure 1:
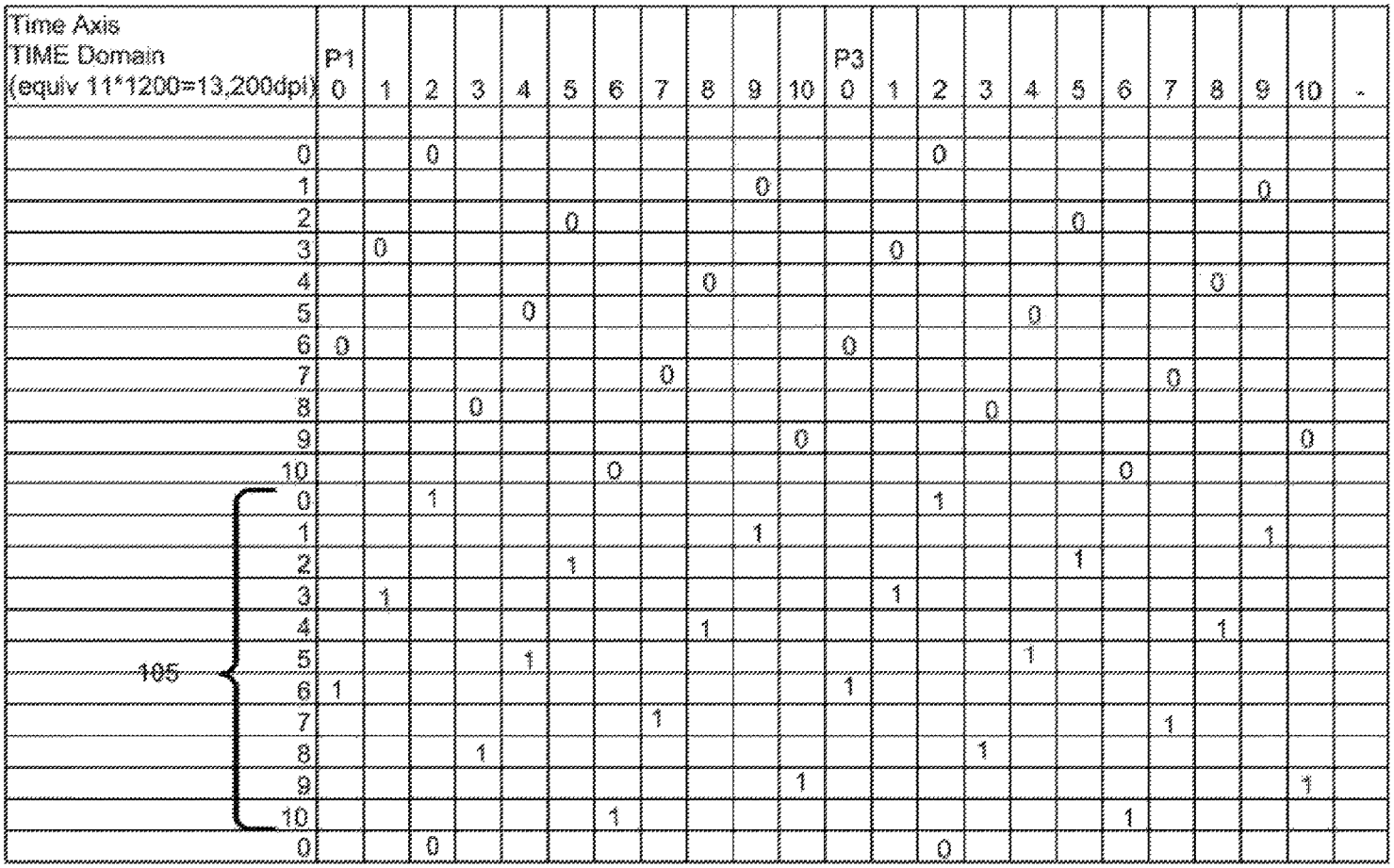
FIG. 1 is a time domain spreadsheet indicating the firing times for a number of nozzles in a printhead according to one example.

In the following description, for purposes of explanation, numerous specific details are set forth in order to provide a thorough understanding of the present systems and methods. However the present apparatus, systems and methods may be practiced without these specific details. Reference in the specification to "an example" or similar language indicates that a particular feature, structure, or characteristic described in connection with that example is included as described, but may not be included in other examples.

In the present specification and in the appended claims, the term "medium" is meant to be understood broadly as any substrate onto which an inkjet printhead may deposit a fluid. In one example, the medium is paper and the fluid is ink.

Additionally, as used in the present specification and in the appended claims, the term "primitive" is meant to be understood broadly as a group of nozzles within a single column of nozzles which together form a single sub-resolution firing cycle. Thus, a single pen of a printhead may comprise a number of dies with each the comprising a number of columns of nozzles with those nozzles being divided further into a number of primitives or groups of nozzles.

Also, as used in the present specification and in the appended claims, the term "scan axis" is meant to be understood broadly as a distance domain equivalent of the "time axis" in the time domain. The direction of the printhead scans across a medium relative to the medium is the scan axis. In some examples, the relative movement of the pen to the medium is due to the medium being fed into the printer. In other examples, the relative motion is due to the printhead moving in the scan axis direction across the medium. In still another example, the relative motion is due to the printhead and the medium moving and moving relative to each other. During printing, an individual nozzle may be fired at a certain digital time-slot along the scan axis direction.

Further, as used in the present specification and in the appended claims, the term "a number of" or similar language is meant to be understood broadly as any positive number comprising 1 to infinity; zero not being a number, but the absence of a number.

As described above, the quality of the printed output produced by the printer may be an important feature to inkjet printer purchasers, and therefore printer manufacturers may attempt to provide a high level of print quality. In order to provide high print quality, each nozzle of the printhead should be able to consistently deposit the desired amount of ink in precisely the proper pixel location on the medium, producing round spots or dots. The droplets of ink may be deposited onto the medium within a dot-row.

For example, where a number of nozzles are firing on a 1,200 dot-per-inch (dpi) grid, a number of individual nozzles may be fired within a number of sub-pixels of a single pixel. In some examples, a 1,200 dpi pixel within the dot-row may be further divided into, for example, 11 sub-pixels. In this example, this allows for a printer to print at 13,200 dpi. Dividing each pixel on the dot-row into sub-pixels provides for a limited amount of power being provided to the printhead than if all nozzles were fired at the same time: in this example, $1/11^{th}$ the power otherwise. Other examples exist where the each 1,200 dpi pixel is divided into a number of sub-pixels other than 11.

A firing sequence of the individual nozzles is shown in FIG. 1. FIG. 1 is a time domain spreadsheet (100) indicating the firing times for a number of nozzles in a printhead according to one example of the principles described herein. The spreadsheet (100) comprises a horizontal axis which describes the nozzles being fired: a number of nozzles being grouped together into primitive (i.e. P1, P3, etc.). The sets of 11 addresses (0-10) represent 11 sub-pixels that a single 1,200 pixel has been broken up into. Thus, the vertical axis represents the firing times of these nozzles such that firing times 0-10 occur over $1/1{,}200$ of an inch. The spreadsheet (100) describes a smearing technique where not all of the nozzles are fired at the same time and instead the firings of each of the nozzles within the set of 11 are spread out temporally. The spreadsheet (100) further shows that each "0" is a point where a nozzle is not firing while a "1" is a point where a nozzle is firing. Thus, firing pattern (105) shows that the respective nozzles are firing while the nozzles are not firing at an earlier or later 1/1,200 of an inch line on the medium. In the present specification and in the appended claims, the term "medium" is meant to be understood broadly as any substrate onto which an inkjet printhead may deposit a fluid. In one example, the medium is paper and the fluid is ink.

FIG. 1 shows which nozzles within a single primitive or group of nozzles are fired. However, the nozzles within the group may be fired in a number of sequences. In one example, the sequence of the firing of the nozzles is 2, 9, 5, 1, 8, 4, 0, 7, 3, 10, and 6 in that order. Although the present specification may describe the firing of these numbered nozzles in this "skip" order, the firing order may vary in other examples. Thus, different firing orders are contemplated in this description. The firing order here, however, provides for a relatively better approximation of a line without a saw-tooth formation being printed if the nozzles were fired in numerical order.

The smearing technique described above, however, has the disadvantage of not firing each appropriate nozzle at the same time. This firing of the sub-groups of nozzles as described above, therefore, results in systematic scan axis directionality ("SAD") or location errors in the direction in which the printhead is scanned across the medium.

In order to overcome the issues associated with the above smearing technique, a staggered pen may be used. With a staggered pen, each of the nozzles of the pen are displaced in the scan axis in an attempt to compensate for the firing order described in connection with FIG. 1. FIG. 2 is a distance domain spreadsheet (200) indicating the firing times for a number of nozzles in a printhead according to another example. The nozzles depicted in FIG. 2, have been moved physically from their positions as those described in FIG. 1 such that they are no longer either vertically or horizontally aligned with neighboring nozzles within a neighboring row of nozzles on the printhead.

In the spreadsheet of FIG. 2, however, even though in the time domain each nozzle within an primitive of nozzles is fired over the 11 locations, each nozzles physical location on the pen allows for the firing of the nozzles such that the dots created by the firing land in the same location in the distance domain. This results in a transform from the time to the distance domain via mechanical placement of the nozzles. One issue does arise with this alternative placement of the nozzles. In some examples, the fluid paths with which the ink in the pen has to travel may affect the way the nozzles deposit the ink. In some cases, the micro-fluidic characteristics of each of the nozzles may differ from each other and from what was expected. Instead, each nozzle may now comprise different flow characteristics such that a discernable pattern may form in any line printed by the pen.

Additionally, in some instances with a staggered pen, the entire pen may not be placed in a printer exactly square to the direction of print. Therefore, if a pen was off from square in comparison to the direction of print, the pen may print in a skewed fashion. Additionally, the dies may be physically offset from each other in the scan axis direction. Still further, the printed image may comprise non-lineal shapes created by a single column. In order to correct this error in staggered pens, full dot row compensation may be used. In the present specification and in the appended claims, the term "full dot row" is meant to be understood as a full 1/1200 line in a 1200 dpi row. This correction can be seen in FIG. 3. FIG. 3 is a distance domain spreadsheet (300) indicating the firing times for a number of nozzles in a printhead according to yet another example. In this spreadsheet (300), scan axis direction errors are corrected in the staggered pen by moving the firing of a number of nozzles to a new 1200 dpi dot row. In this case, a straight line is being drawn, but with the theta-Z error the firing of a number of nozzles is moved a full $1/1200^{th}$ of an inch line. A theta-Z error is a scan axis error in which a straight line has been optically separated into a number of disjointed line segments. The above described method may be referred to as full dot row (FDR) compensation. In addition to the issues described above in connection with staggered pens generally, implementation of the FDR compensation in this manner produces noticeable defects in the printed product. For example, at locations where the break occurs in the line and the FDR compensation is used to shift the line, relatively course features appear. Additionally, with a pen that fires a number of colors to produce colors other than, for example, cyan, magenta, yellow, and black, the color combinations may not be appropriately made because some of the color pens may not fire the nozzles using the same FDR compensation. As a result, colors may look different than what was intended.

Figure 4:
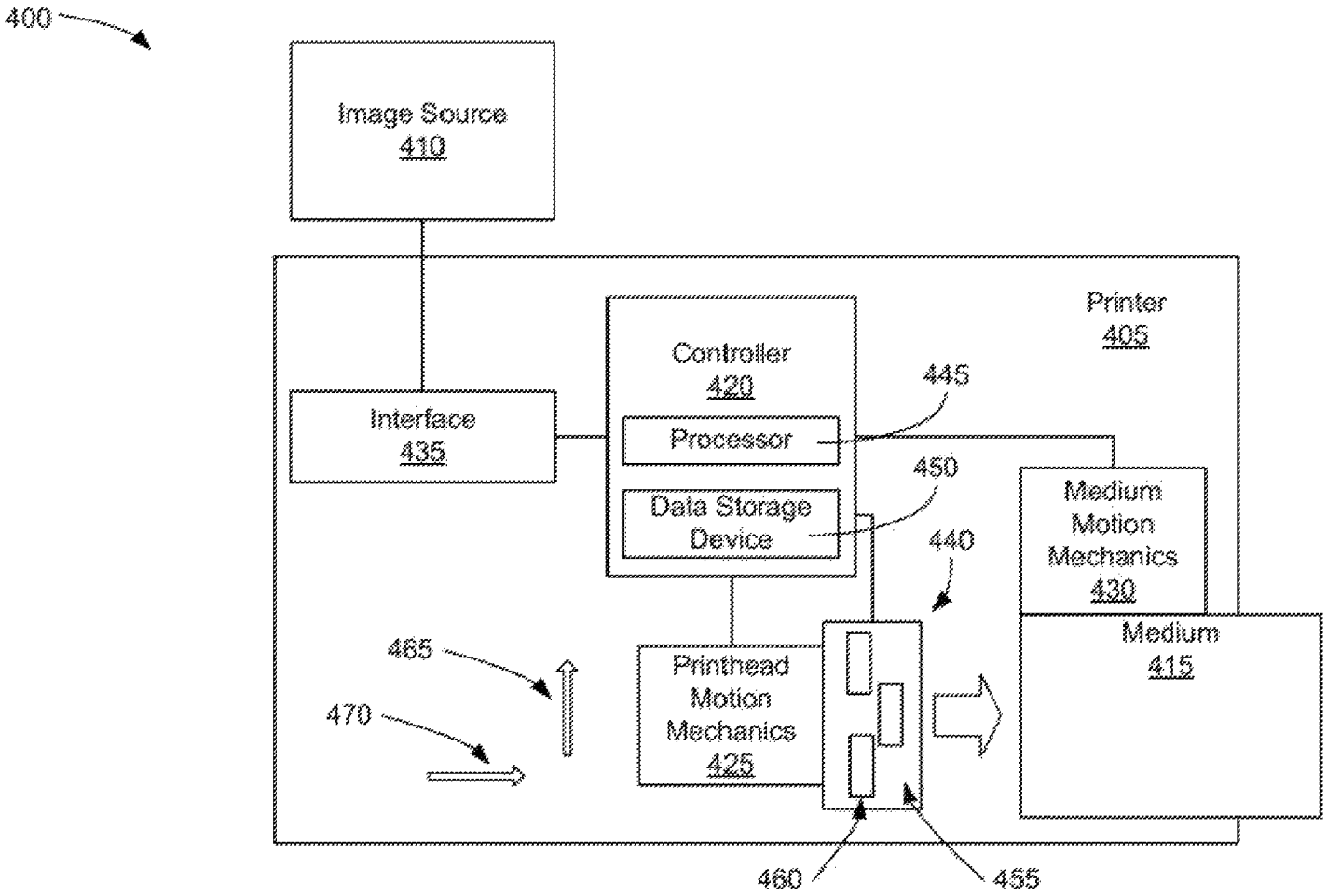
FIG. 4 is a diagram of a printing system according to one example of the principles described herein.

Turning now to FIG. 4, a printing system (400) according to one example described herein is shown. The printing system (400) may comprise a printer (405), an Image source (410), and a medium (415). The printer (405) may comprise a controller (420), printhead motion mechanics (425), medium motion mechanics (430), an interface (435), and a printhead (440). The controller (420) may comprise a processor (445) and a data storage device (450). Each of these will now be described in more detail.

The printer (405) may comprise an interface (435) to interface with an image source (410). The interface (435) may be a wired or wireless connection connecting the printer (405) to the image source (410). The image source may be any source from which the printer (405) may receive data describing a print job to be executed by the controller (420) of the printer (405) in order print an image onto the medium (415). In one example, the image source may be a computing device in communication with the printer (405).

The interface (435) enable the printer (405) and specifically the processor (420) to interface with various other hardware elements like the image source (410), external and internal to the printer (405). For example, the interface (435) may interface with an input or output device such as, for example, display device, a mouse, or a keyboard. The interface (435) may also provide access to other external devices such as an external storage device, a number of network devices such as, for example, servers, switches, and routers, client devices, other types of computing devices, and combinations thereof.

The processor (445) may include the hardware architecture to retrieve executable code from the data storage device (450) and execute the executable code. The executable code may, when executed by the processor (445), cause the processor (445) to implement at least the functionality of printing on the medium (415), and actuating the printhead and medium motion mechanics (425, 430), according to the methods of the present specification described herein. In the course of executing code, the processor (445) may receive input from and provide output to a number of the remaining hardware units. Additionally, the processor may receive firmware from a data storage device (450) in the form of computer usable program code. The firmware may comprise computer usable program code to, when executed by a processor, adjust the firing time of a number of nozzles within a group of nozzles of the printhead by? a portion of a dot-row. This may be done by selectively delaying the firing of a number of those nozzles within that group of nozzles.

The data storage device (450) may store data such as executable program code that is executed by the processor (445) or other processing device. The data storage device (450) may specifically store computer code representing a number of applications that the processor (445) executes to implement at least the functionality described herein.

The data storage device (450) may include various types of memory modules, including volatile and nonvolatile memory. For example, the data storage device (450) of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device (450) as may suit a particular application of the principles described herein. In certain examples, different types of memory in the data storage device (450) may be used for different data storage needs. For example, in certain examples the processor (445) may boot from Read Only Memory (ROM) (450), maintain nonvolatile storage in the Hard Disk Drive (HDD) memory, and execute program code stored in Random Access Memory (RAM).

Generally, the data storage device (450) may comprise a computer readable medium, a computer readable storage medium, or a non-transitory computer readable medium, among others. For example, the data storage device (450) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The printhead and medium motion mechanics (425, 430) comprise mechanical devices that may move the printhead (440) and medium (415) respectively. Instructions to move the printhead (440) and medium (415) may be received and processed by the controller (420) and signals may be sent to the printhead (440) and medium motion mechanics (430) from the controller (420).

As discussed above, the printhead (440) may comprise a number of nozzles. In some examples, the printhead (440) may comprise a number of pens (455) comprising a number of colors. In the example, shown in FIG. 4, the printhead (440) is a single pen (455). However, a printer (405) may comprise a plurality of pens (455) and FIG. 4 is meant merely as an example. Each pen may further comprise a number of dies (460). These dies (460) may each comprise a number of columns of nozzles. For references purposes, FIG. 4 comprises nozzle axis arrow (465) and a scan axis arrow (470). The nozzle axis arrow (465) indicates the axis of the nozzles within each column of nozzles. The scan axis arrow (470) indicates the direction at which the pen (455) scans across the medium (415).

The number of columns of nozzles within each the (460) may vary. In one example, the number of columns of nozzles may be eight. In addition, the number of columns of nozzles within each the (460) may be separated into groups of columns with each group of columns ejecting a different color of fluid or ink from the nozzles within those columns. In one example, a the (460) having 8 columns of nozzles may be separated into 4 groups with each group having 2 columns and in which each group ejects from their nozzles a different color. In this example, the colors may comprise cyan, magenta, yellow, and black. The number of pens (455), dies (460), groups of columns, and columns may vary and the present application contemplates varying numbers of each of these elements independent of each other.

The number of columns of nozzles may further be divided up into primitive or groups of nozzles which act in concert during a single firing cycle. Again, the number of nozzles within each primitive may vary and the present application contemplates for any number of nozzles within a primitive. In one example, a single primitive may comprise 11 nozzles. In the example where two columns of nozzles are used to eject a single color of fluid, in order to achieve a $1/1200^{th}$ spacing in the nozzle axis or the axis at which the column of nozzles lies, any two columns of nozzles may be offset from each other by $1/1200^{th}$ of an inch with each nozzles in the individual columns being spaced $1/600^{th}$ of an inch from each other.

Figure 5A:
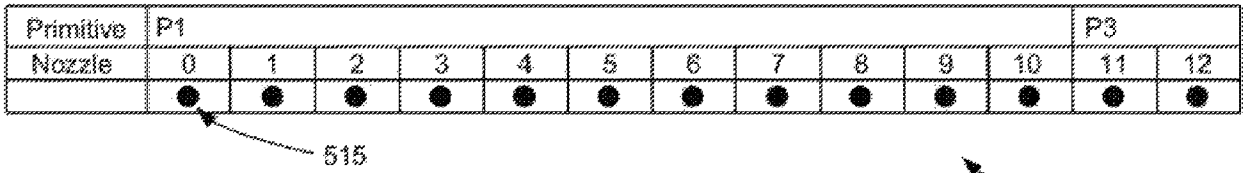
FIGS. 5A and 5B are top views of a printhead showing two layouts of nozzles according to one example of principles described herein.
Figure 5B:
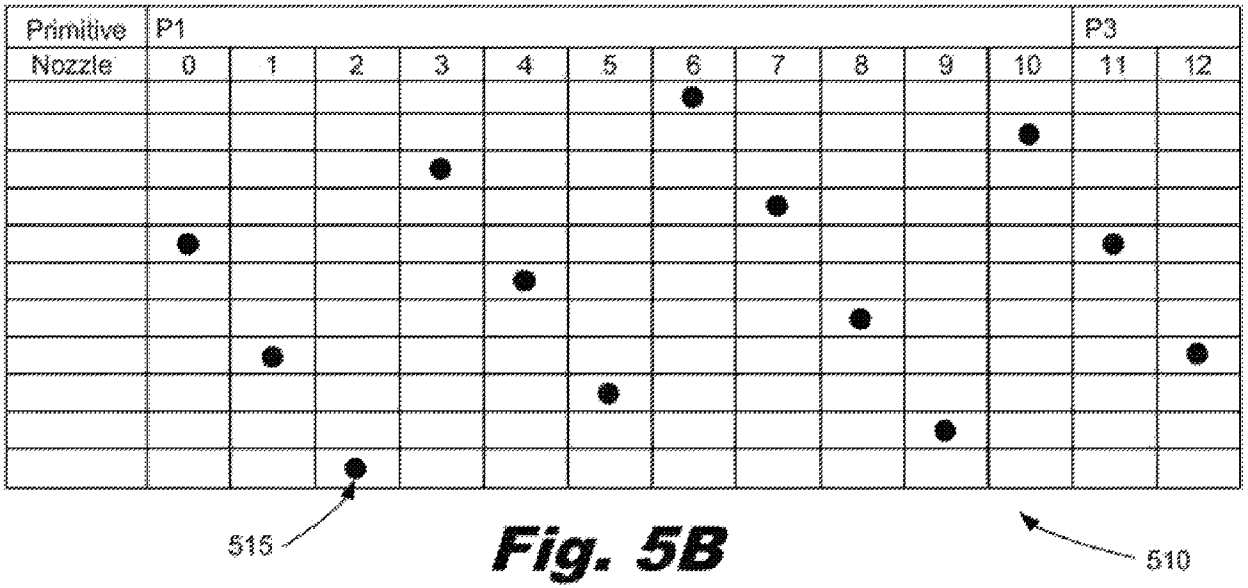

Turning now to FIGS. 5A and 5B two types of nozzle layouts are shown according to two examples of the principles described herein. FIG. 5A shows a layout of a number of nozzles within a the of a non-staggered printhead (505) white FIG. 5B shows a layout of a number of nozzles within a die of a staggered printhead (510). In FIG. 5A, the nozzles (515) are non-staggered such that each nozzle within a column are aligned with each other nozzle (515) within the same column of nozzles. In FIG. 5B, the nozzles (520) are staggered such that any given nozzle (520) within a single column of nozzles is not aligned with any other nozzles (520) in that same column. The staggering, in one example may occur over $1/1200^{th}$ of an inch in the scan axis direction. It can be seen, therefore, that the nozzles on the die (FIG. 4, 460) of a staggered pen are laid out such that firing order of the nozzles according to the description of FIG. 1 would create the domain spreadsheet as described in FIG. 1, thereby undoing the time domain aspect of the non-staggered pen.

FIGS. 5A and 5B each show a number of nozzles defined within the printhead (505, 510). Additional nozzles (510, 520) may be defined within the printhead (505, 510) and the present specification contemplates any number of nozzles (515, 520). In one example, number of nozzles (515, 520) may be 42,240 nozzles with the number of nozzles (515, 520) being separated into different primitives. In one example, the number of groups may be 11 there by separating the nozzles into groups of 3840 nozzles with each of those nozzles within any given group firing at the same time.

Figure 6:
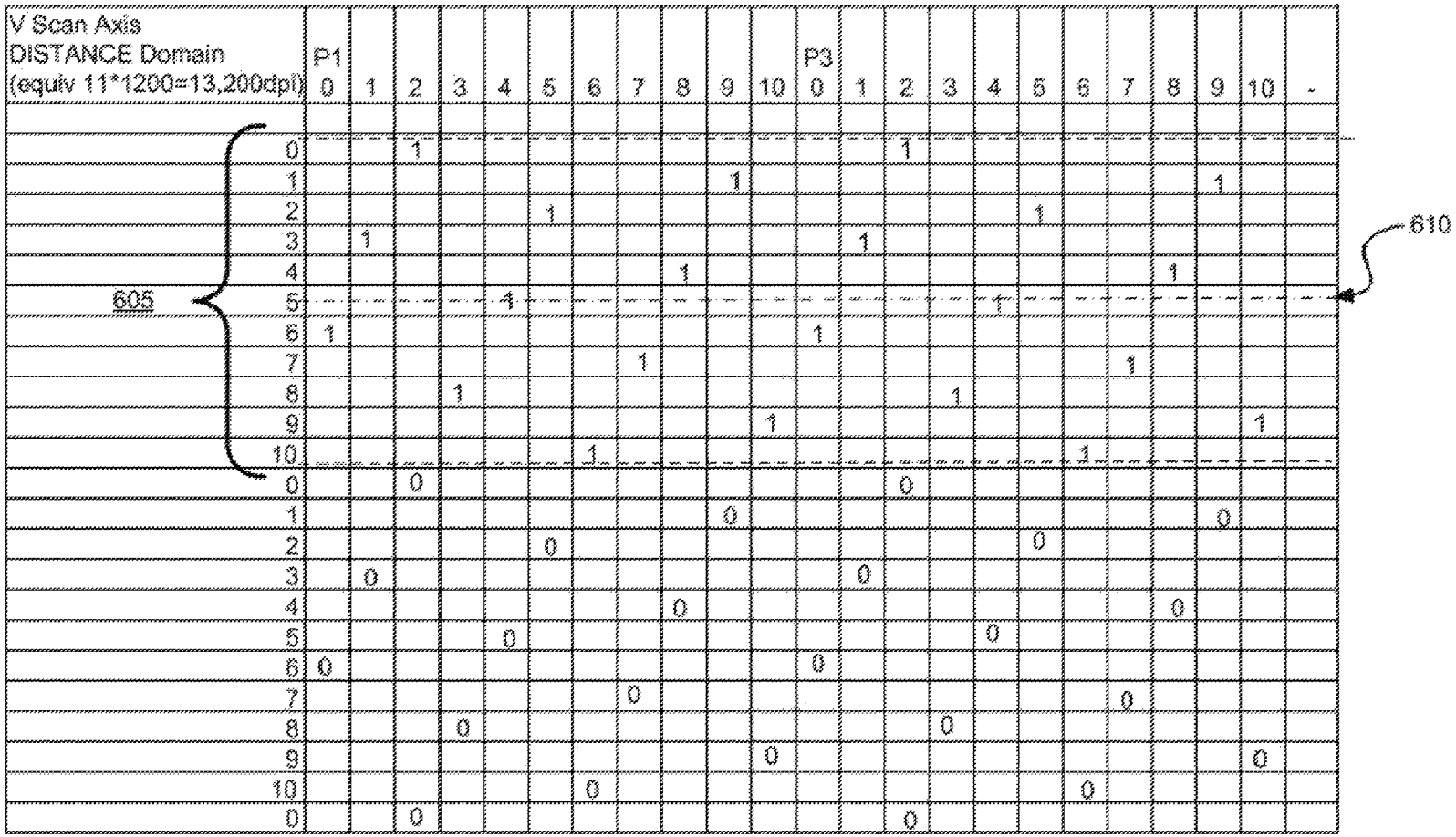
FIG. 6 is a distance domain spreadsheet indicating the firing times for a number of nozzles in a printhead according to one example of the principles described herein.

FIG. 6 is a distance domain spreadsheet (600) indicating the firing times for a number of nozzles in a printhead according to one example of the principles described herein. The spreadsheet (600) depicts a printhead having a non-staggered nozzle layout. The bracket (605) highlights those nozzles that will fire to form a fine on a page using a "1". The "0" indicates that the nozzles are not firing. A center line (610) has been drawn on the spreadsheet (600) indicated at approximately 5½ of the 1,200 dpi row. In this case, the 5½ line is equal to approximately the center of the line that is printed on the medium (FIG. 4, 415).

Figure 7:
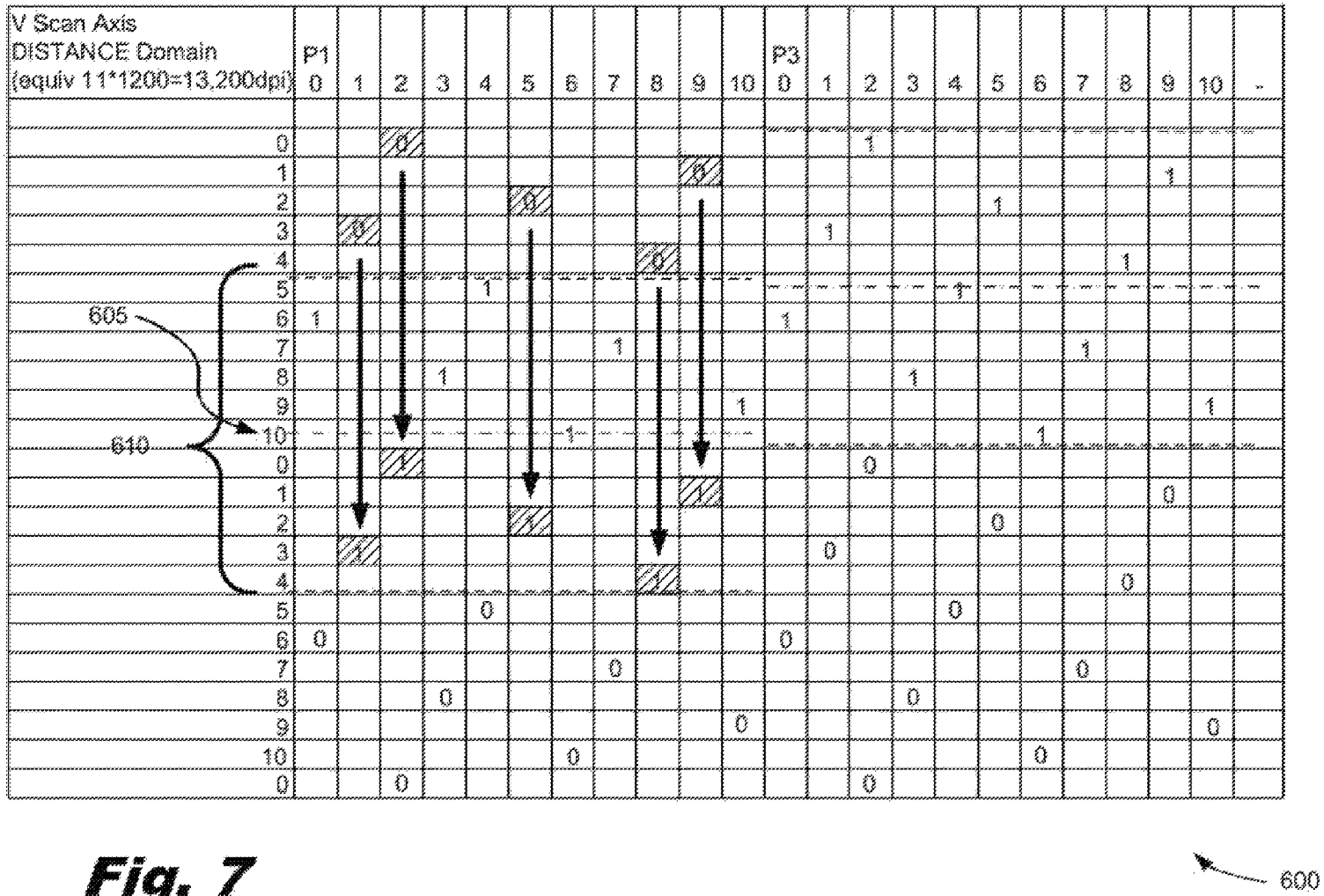
FIG. 7 is the distance domain spreadsheet of FIG. 6 indicating the firing times for a number of nozzles in a printhead according to the example of the principles described herein.

Turning now to FIG. 7 the distance domain spreadsheet (600) is again shown indicating the firing times for a number of nozzles in a printhead according to the example of the principles described in FIG. 6. In this case, FIG. 7 shows a non-staggered column of nozzles with at least one primitive firing at about a half dot row in the scan axis direction: the entire full dot row being moved by about a half dot row in the scan axis direction or $^{5}/_{11}$ths. Thus, in FIG. 7, the dot row may be moved by a half thereby creating a relatively more defined fine on a printed image and the ability to correct for any errors within the printing system (400) such as theta-z errors. The center line (605) is moved from the 5½ line to the 10½ line while the center line of the adjacent primitive of nozzles remains at the 5½ line, indeed, at any point along any column of nozzles, any primitive of nozzles may be shifted as described above. As can be seen by the shaded blocks and arrows in FIG. 6, the firings of nozzles 1, 2, 5, 8, and 9 have been delayed for a full cycle while the firing of nozzles 0, 3, 4, 6, 7, and 10 have not been delayed. Thus by delaying half of the firing nozzles by one full cycle or 11 positions on the spreadsheet (700), a less than a full dot row correction is realized by using the full dot row correction interacting with the firing pattern as shown in FIG. 7.

Figure 8:
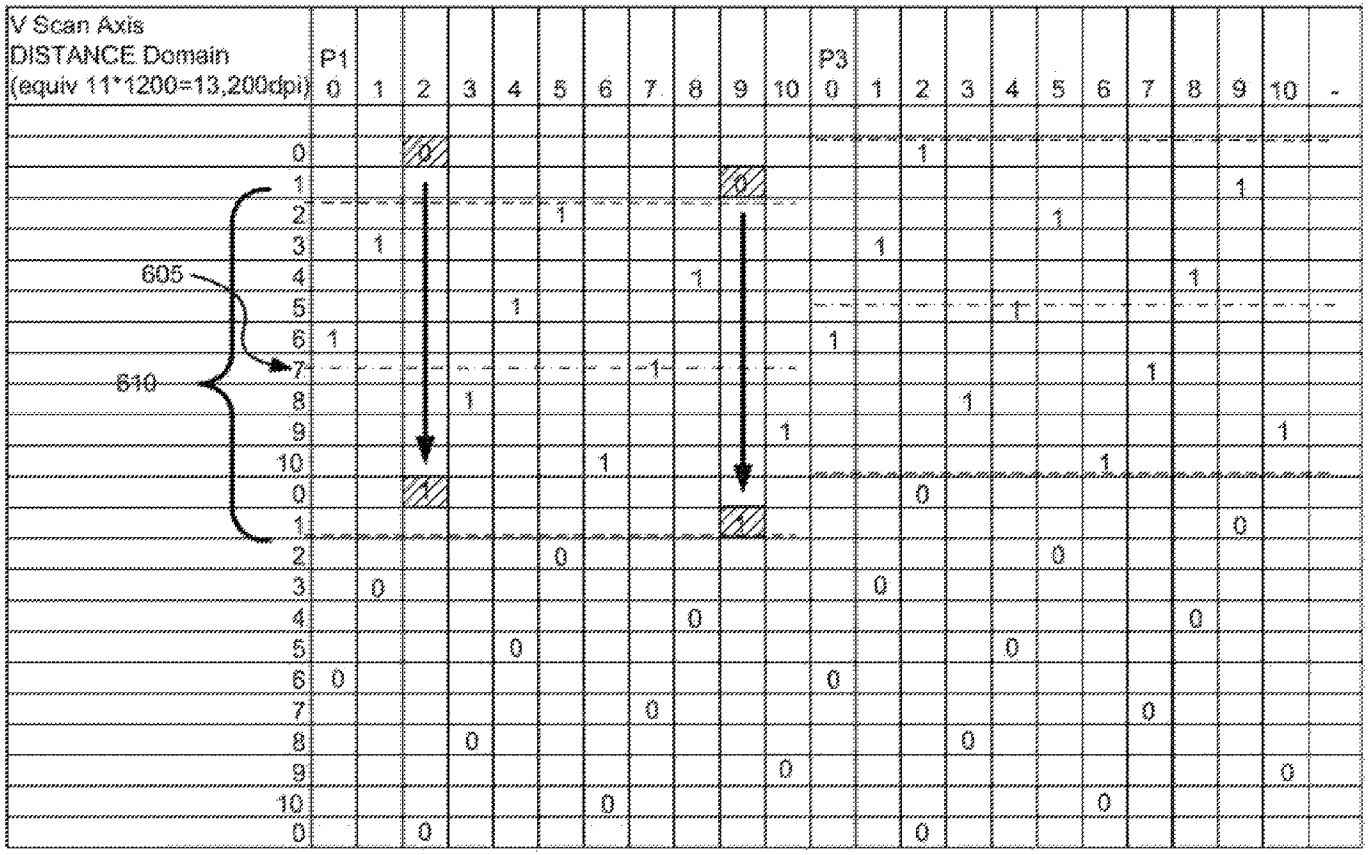
FIG. 8 is the distance domain spreadsheet of FIG. 6 indicating the firing times for a number of nozzles in a printhead according to the example of the principles described herein.

FIG. 8 is also the distance domain spreadsheet of FIG. 6 indicating the firing times for a number of nozzles in a printhead according to the example of the principles described herein. In the example shown in FIG. 8, a quarter dot row is realized by shifting a full dot row by $^{1}/_{4}{}^{th}$ the distance. Again, this may be accomplished by delaying the firing of a quarter of the nozzles by a quarter of a firing cycle. In this example, the line or a portion of the line so shifted is moved about a fifth of a full dot row or $^{2}/_{11}$ths. Specifically, nozzles 2 and 9 are moved a full dot row while nozzles 0, 1, 3, 4, 5, 6, 7, 8, and 10 are not moved.

Figure 9:
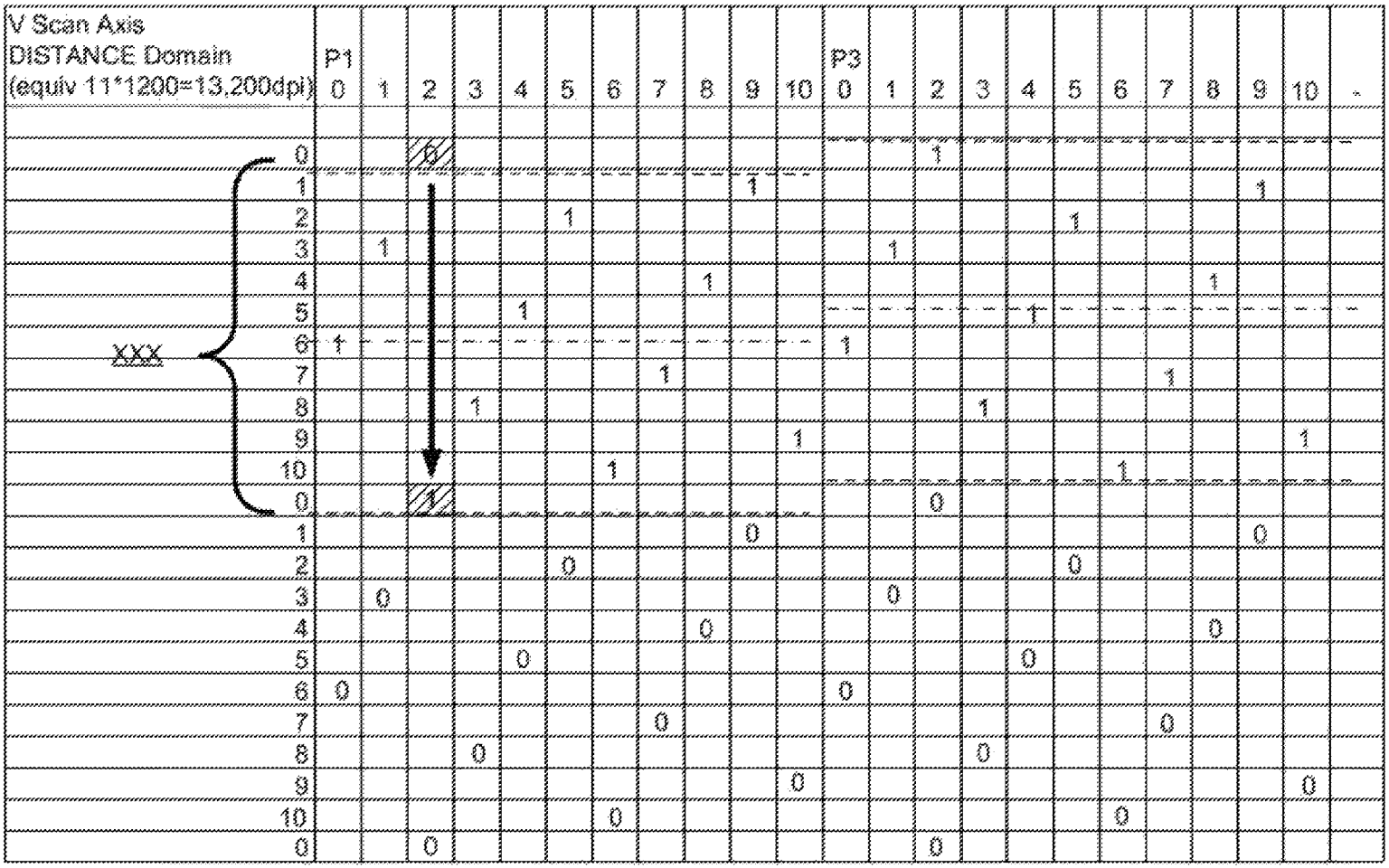
FIG. 9 is the distance domain spreadsheet of FIG. 6 indicating the firing times for a number of nozzles in a printhead according to the example of the principles described herein.

FIG. 9 is also the distance domain spreadsheet of FIG. 6 indicating the firing times for a number of nozzles in a printhead according to the example of the principles described herein. In the example shown in FIG. 9, a full dot row is adjusted by $^{1}/_{11}{}^{th}$ of its width such that one nozzle is delayed while all other nozzles are not delayed. Specifically, because the order of firing the nozzles is 2, 9, 5, 1, 8, 4, 0, 7, 3, 10, and 6 in that order, nozzle 2 is delayed while all other nozzles are not. The line is therefore moved $^{1}/_{11}{}^{th}$ of a full dot row or effectively one sub-pixel of the 1,200 dpi pixel. This allows for even finer adjustments of the printed line as described in FIGS. 6 and 7 and allows for the line to be moved $^{1}/_{11}{}^{th}$ or $^{1}/_{13,200}{}^{th}$ of an inch. Although FIGS. 6, 7, 8, and 9 show a situation where a single 1,200 dpi pixel is broken up into 11 sub-pixels, the present specification contemplates for the 1,200 dpi pixel being broken up into more sub-pixels in order to achieve a higher resolution via the line shifting as described above. Still further, the scan axis resolution-cycle of $^{1}/_{1,200}{}^{th}$ of an inch is merely an example, and the resolution-cycle may be changed via changing computer program code during run-time.

The corrections as described above in connection with FIGS. 6-9 allow for relatively increased resolution of prints while adjusting more accurately to errors that may be caused by small imperfections in the mechanics of the printer (FIG. 4, 405), the pen, the dies, and/or the nozzles. A line that would have been printed at a diagonal may now be printed horizontally with extreme accuracy not seen before. Although FIGS. 6-9 show a portion of a line that is to be printed, the principles described herein can be expanded to print any length of line having the improved resolution described here. Indeed, by adjusting the delay of any particular nozzle over a distance, curved lies may also appear to be less saw-toothed and more defined. Still further, the present system and method does not increase the costs of changing the electronics in the printer (FIG. 4, 405) thereby saving in costs of manufacturing.

Figure 10:
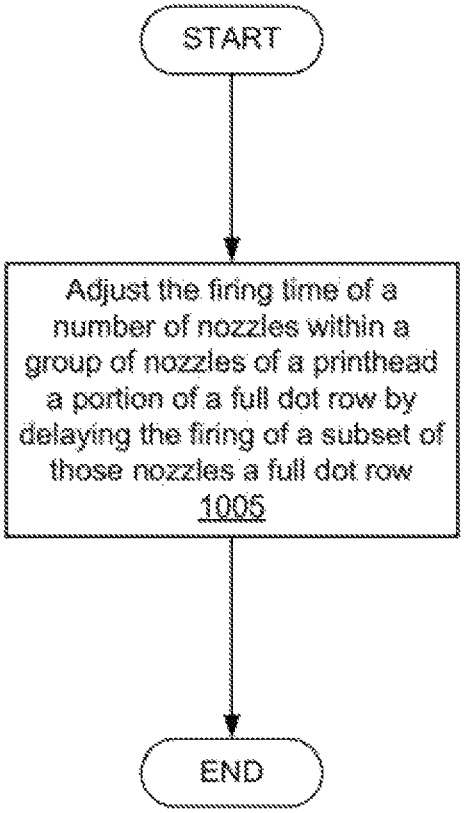
FIG. 10 is a flowchart depicting a method of adjusting the resolution of a printed document according to one example of the principles described herein.

FIG. 10 is a flowchart depicting a method of adjusting the resolution of a printed document according to one example of the principles described herein. The method may begin with a processor (FIG. 4, 445) adjusting (1005) the firing time of a number of nozzles within a group of nozzles of a printhead a portion of a full dot row by delaying the firing of a subset of those nozzles a full dot row; a subset of nozzles being less then the entire group of nozzles. As described above, the number of nozzles adjusted may depend on the intended amount by which a user directs the line to be adjusted. Specifically, the processor, in a 1200 dpi dot row with each pixel of the dot row being divided into 11 sub-pixels, adjusts the correction of a primitive line segment in increments of $^{1}/_{13,200}$ths of an inch.

Additionally, a computer program product for adjusting the resolution of a printed document is also described herein. The computer program product may comprise a computer readable storage medium comprising computer usable program code embodied therewith, the computer usable program code comprising computer usable program code to, when executed by a processor, delay the firing of a number of nozzles within a group of nozzles of a printhead a portion of a dot row. The nozzles of the printhead may be non-staggered such that the nozzles of the printhead are aligned vertically and horizontally with each other nozzle.

The specification and figures describe a printer and a method for adjusting the resolution of a printed document. The printer provides for the selective adjustment of printed line by adjusting the firing time of a number of nozzles within a group of nozzles a portion of a dot row on a non-staggered printhead. This printer and method may have a number of advantages, including higher resolution of printed documents with little or no manufacturing costs due to extra hardware or redesign of a printer.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printer comprising:

a printhead comprising a number of non-staggered nozzles; and a processor communicatively coupled to the printhead;

in which the processor executes computer usable program code to:

adjust the firing time of a number of nozzles within a group of nozzles by a portion of a full dot row.

2. The printer of claim 1, in which the computer usable program code adjusts the firing time of a number of nozzles by delaying the firing of a number of nozzles.

3. The printer of claim 1, in which adjustment of the firing time of a number of nozzles corrects errors created in the scan axis direction.

4. The printer of claim 1, in which the group of nozzles comprises a portion of all nozzles within a single column of nozzles.

5. The printer of claim 1, in which a single dot-row pixel of the dot-row is divided into 11 sub-pixels and in which a single nozzle firing is delayed such that the dot row is adjusted by 1/11th the width of the 1200 dpi dot row resulting in a movement of the line by 1/13,200th of an inch.

6. A method comprising:

with a processor, adjusting the firing time of a number of nozzles within a group of nozzles of a printhead by a portion of a full dot row by delaying the firing of a subset of those nozzles by a full dot row;

in which the nozzles of the printhead are not staggered.

7. The method of claim 6, in which adjusting the firing time of the nozzles corrects errors in the scan axis direction created by mechanical defects of a printer operating the printhead.

8. The method of claim 6, in which the group of nozzles comprises a portion of all nozzles within a single column of nozzles of the printhead.

9. The method of claim 6, in which the dot row comprises a number of dot row pixels and in which each dot row is divided into a number of sub-pixels.

10. The method of claim 9, in which each dot row is divided into 12 sub-pixels, and in which a single nozzle firing among 12 nozzles is delayed.

11. A computer program product for adjusting the resolution of a printed document, the computer program product comprising:

a compute readable storage medium comprising computer usable program code embodied therewith; the computer usable program code comprising:

computer usable program code to, when executed by a processor, delay the firing of a number of nozzles within a group of nozzles of a printhead by a portion of a dot row;

in which the nozzles of the printhead are not staggered; and in which the portion of a dot row is equal to a quarter of the dot row.

12. The computer program product of claim 11, in which delay the firing of a number of nozzles within a group of nozzles corrects errors in the scan axis direction created by mechanical defects of a printer operating the printhead.

13. The computer program product of claim 11, in which the group of nozzles comprises a portion of all nozzles within a single column of nozzles of the printhead.

14. The computer program product of claim 11, in which the dot row comprises a number of dot row pixels and in which each dot row is divided into a number of sub-pixels.

15. The computer program product of claim 14, in which each dot row is divided into 12 sub-pixels, and in which a single nozzle firing among 12 nozzles is delayed.

* * * * *